US007765626B2

(12) United States Patent
Sapia

(10) Patent No.: US 7,765,626 B2
(45) Date of Patent: Aug. 3, 2010

(54) DRAIN-CLEARING DEVICE

(76) Inventor: Franco Sapia, 9 Fairway Dr., Apt. 26, Derry, NH (US) 03038

( * ) Notice: Subject to any disclaimer, the term of this patent is extended or adjusted under 35 U.S.C. 154(b) by 945 days.

(21) Appl. No.: 11/534,484

(22) Filed: Sep. 22, 2006

(65) Prior Publication Data

US 2008/0097351 A1 Apr. 24, 2008

(51) Int. Cl.
*E03D 11/00* (2006.01)

(52) U.S. Cl. ..... 4/255.11; 4/255.08; 4/255.05; 15/104.33

(58) Field of Classification Search ..... 4/255.11, 4/255.12, 255.04, 255.05, 255.07, 255.08, 4/255.01; 15/104.33
See application file for complete search history.

(56) References Cited

U.S. PATENT DOCUMENTS 1,175,256 A * 3/1916 Gruver ..... 15/104.16
1,218,764 A * 3/1917 Hanlein ..... 4/255.11
1,261,444 A * 4/1918 Schied ..... 4/255.01
1,852,454 A * 4/1932 Foster ..... 16/108
2,129,415 A * 9/1938 Fontenot ..... 4/255.03
2,237,880 A * 4/1941 Von Bon Horst et al. . 15/104.33
2,241,560 A * 5/1941 Schouler ..... 15/104.33
2,244,735 A * 6/1941 Silverman ..... 15/104.33
2,279,769 A * 4/1942 Von Bon Horst et al. ..... 24/523
2,473,452 A * 6/1949 Scott ..... 4/255.11
2,961,675 A * 11/1960 Stickney ..... 15/104.33
4,174,548 A * 11/1979 Dunn ..... 15/104.33
4,364,140 A * 12/1982 Irwin ..... 15/104.33
5,107,550 A * 4/1992 Hawro ..... 4/255.08
5,230,116 A * 7/1993 Rodriguez ..... 15/104.33
5,423,621 A * 6/1995 Russell ..... 401/9
5,500,974 A * 3/1996 Wu ..... 15/104.33
5,862,534 A 1/1999 Clay
6,421,871 B1 * 7/2002 Peach et al. ..... 15/104.33
6,898,807 B2 5/2005 Tash
2005/0251938 A1 11/2005 Hofer, Sr. et al.
2007/0089254 A1 * 4/2007 Alaine ..... 15/104.33
2008/0083058 A1 * 4/2008 Heffner ..... 4/255.01

* cited by examiner

*Primary Examiner*—Khoa D Huynh
(74) *Attorney, Agent, or Firm*—Dale J. Ream

(57) ABSTRACT

A drain clearing device includes a first hollow tube having opposed first and second ends and a plunger head coupled to the first end. A second hollow tube includes a first end operatively coupled to the first end of the first tube, the first and second tubes being configured for telescoping movement between extended and retracted configurations. A snaking member is situated in the first and second tubes for movement between storing and operating configurations when the tubes are moved between extended and retracted configurations, respectively. A crank handle connected to the snaking member enables a user to rotate and extend the snake as needed. A plug is included for separating an inner tube area from an inner area of the plunger head and to prevent water spillage from the tubes.

6 Claims, 5 Drawing Sheets

DRAIN-CLEARING DEVICE

BACKGROUND OF THE INVENTION

The present device relates generally to plumbing accessory devices and, more particularly, to a drain clearing device having a plunger and snaking device integrated in a dual tube arrangement.

A plunger is a plumbing accessory that is traditionally used to unclog a toilet that has become obstructed. The plunger includes a semi-flexible head with which to apply suction to the trap of the toilet. However, there are times when use of the plunger alone is insufficient to clear the obstruction. In such a case, a plumbing snake may be utilized. A plumbing snake typically utilizes an elongate, flexible metal wire or cord that may be extended into or even through the toilet trap to forcefully dislodge or break up the obstruction.

A plunger is usually the first plumbing accessory that is employed when an obstruction is experienced as the plunger is usually sufficient to remedy the problem. If unsuccessful, the user faces the disadvantages of obtaining and using a plumbing snake. It would therefore be desirable to have a device that combines the advantages of a plunger and a snaking device. Various devices are known in the art that combine the basic characteristics of these two devices. Although assumably effective for their intended purposes, the existing devices do not seal the snaking device within the handle of the plunger so as to eliminate water spillage issues, provide a two-part extended handle configuration, or have a convenient crank handle for operation of the snaking device.

Therefore, it would be desirable to have a drain clearing device that overcomes the limitations described above.

SUMMARY OF THE INVENTION

A drain clearing device according to the present invention includes a first hollow tube having opposed first and second ends and a plunger head coupled to the first end. The drain clearing device includes a second hollow tube having opposed first and second ends, the first end of the second hollow tube being operatively coupled to the second end of the first hollow tube. The first and second hollow tubes are configured for telescoping movement between an extended configuration and a retracted configuration.

Further, a snaking member is positioned in the first and second hollow tubes and movement of the hollow tubes between the extended and retracted configurations causing the snaking member to move between storing and operating configurations, respectively. A crank handle is coupled to the second end of the second hollow tube and is coupled to the snaking member for selective rotational movement thereof. In addition, the drain clearing device includes a plug for selectively sealing an inner area of said first hollow tube from an inner area of said plunger head, whereby to eliminate water spillage issues.

Therefore, a general object of this invention is to provide a drain clearing device having a plunger head and snaking device for unclogging a toilet.

Another object of this invention is to provide a drain clearing device, as aforesaid, having first and second tubes that are configured for telescoping movement between extended and retracted configurations.

Still another object of this invention is to provide a drain clearing device, as aforesaid, in which the snaking member is positioned within the first and second tubes and having a crank handle for operating the snaking member.

A further object of this invention is to provide a drain clearing device, as aforesaid, having a plug for sealing an inner area of the first tube and preventing water spillage.

A still further object of this invention is to provide a drain clearing device, as aforesaid, that is easy to use and economical to manufacture.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1A:
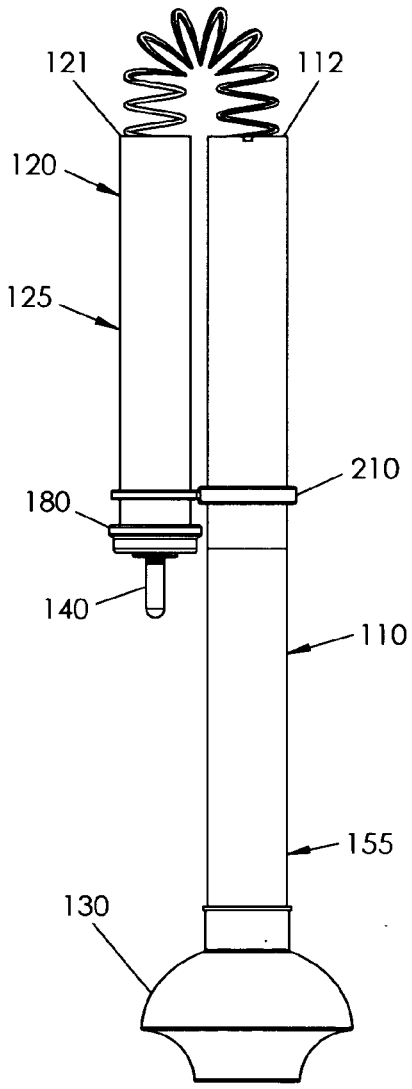
FIG. 1*a* is a side view of a drain clearing device according to a preferred embodiment of the present invention in a retracted configuration.

A drain-clearing device 100 particularly for use with a toilet or sink according to the present invention will now be described in detail with reference to FIGS. 1*a* through 4*c* of the accompanying drawings. More particularly, a drain-clearing device 100 according to the current invention includes a first hollow tube 110, a second hollow tube 120, a plunger head 130, a crank handle 140, and a snaking member 150.

Figure 1B:
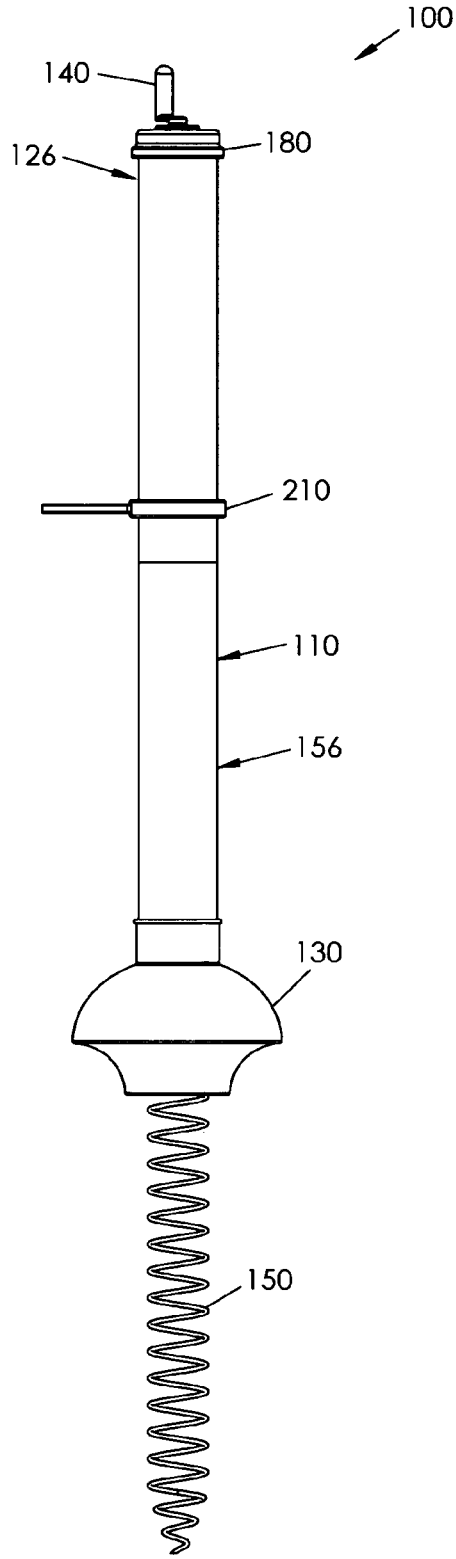
FIG. 1*b* is a side view of the drain clearing device as in FIG. 1*a* in an extended configuration.
Figure 2:
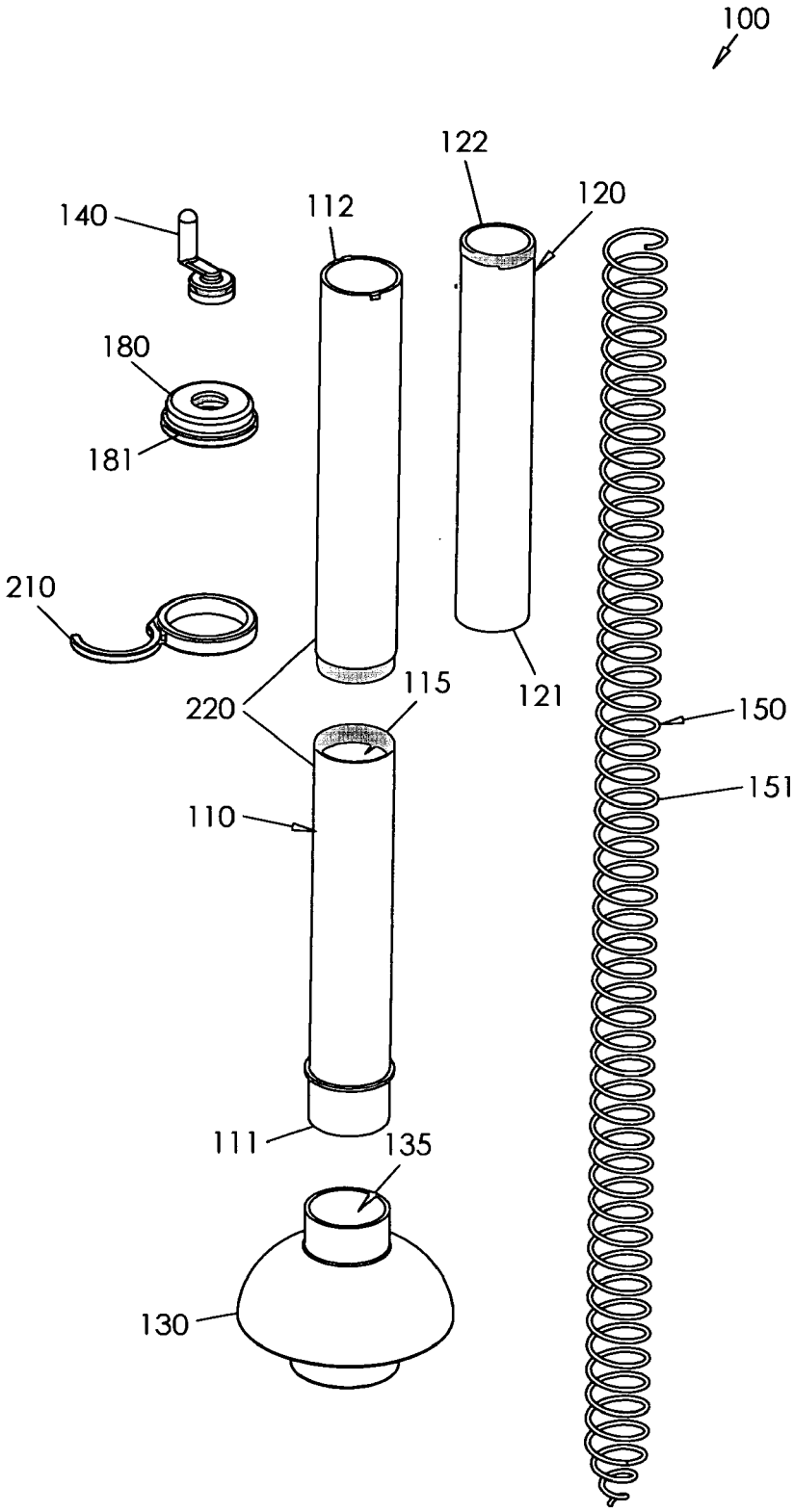
FIG. 2 is an exploded view of the drain clearing device as in FIG. 1*b;*

The first hollow tube 110 has opposed first and second ends 111, 112 and defines an inner area 115 (FIGS. 1 and 2). The second hollow tube 120 has opposed first and second ends 121, 122. The first end 121 of the second hollow tube 120 is operatively coupled to the second end 112 of the first hollow tube 110 so that the first hollow tube 110 and the second hollow tube 120 are configured for telescoping movement between an extended configuration 125 (FIGS. 1*a* and 3*a*) and a retracted configuration 126 (FIGS. 1*b* and 4*a*). The second hollow tube 120 may have a smaller diameter than a diameter of the first hollow tube 110 to allow insertion of the second hollow tube 120 inside the first hollow tube when at the retracted configuration 126 (FIG. 4*c*). A flexible rubber hose 190 may couple the second end 112 of the first hollow tube 110 to the first end 121 of the second hollow tube 120 when the hollow tubes 110, 120 are at the extended configuration 125 (FIG. 5).

Figure 3A:
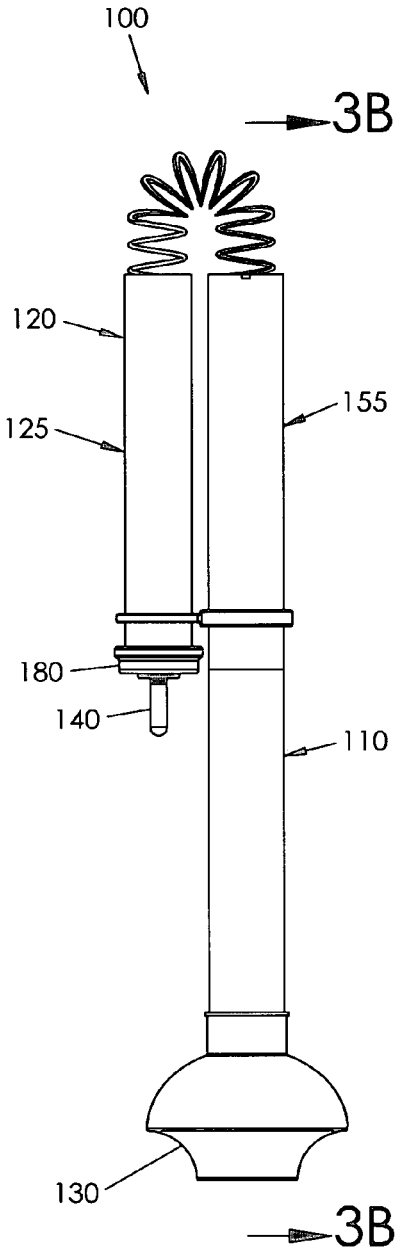
FIG. 3*a* is another side view of the drain clearing device as in FIG. 1*a;*
Figure 4A:
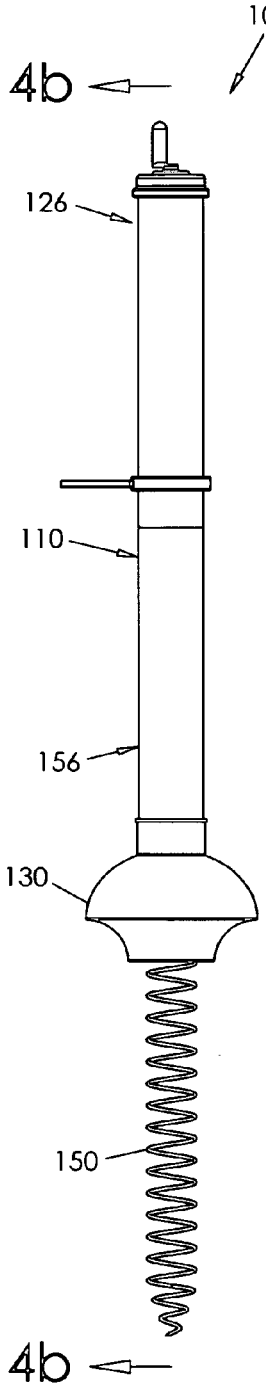
FIG. 4*a* is another side view of the drain clearing device as in FIG. 1*b;*

When the first and second tubes 110, 120 are at the extended configuration 125, as shown in FIGS. 1*a* and 3*a*, the first hollow tube 110 may be parallel with the second hollow tube 120. Moreover, when the first and second tubes 110, 120 are at the extended configuration 125, the second end 122 of the second hollow tube 120 may be located between the first and second ends 111, 112 of the first hollow tube 110 and a bracket 210 (FIG. 2) may selectively maintain the first and second tubes 110, 120 in a parallel relationship as shown in FIGS. 1*a* and 3*a*. The first hollow tube 110 may be comprised of a plurality of tube portions 220 threadably or otherwise coupled together as shown in FIG. 2, or the first hollow tube 110 may be a single member.

Figure 4B:
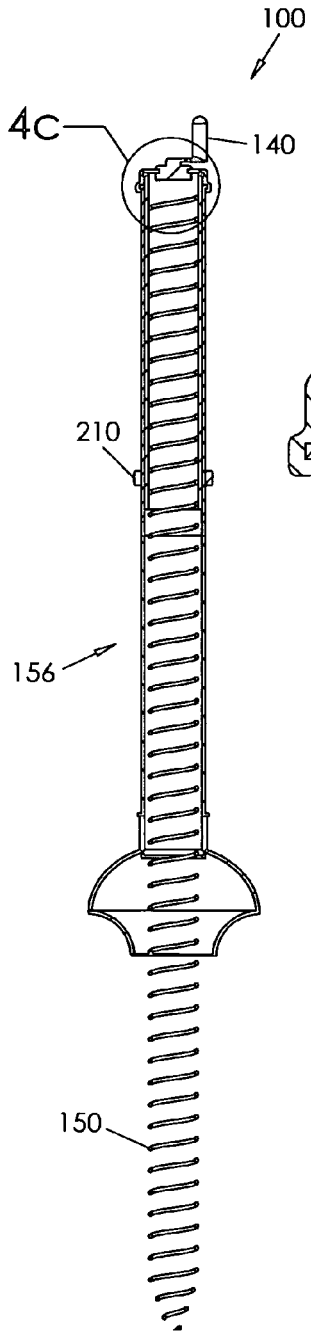
FIG. 4*b* is a sectional view taken along line 4*b*-4*b* of FIG. 4*a;*
Figure 4C:
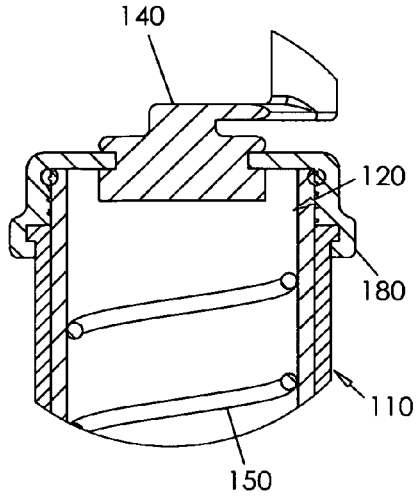
FIG. 4*c* is an isolated view on an enlarged scale taken from FIG. 4*b.
Figure 5:
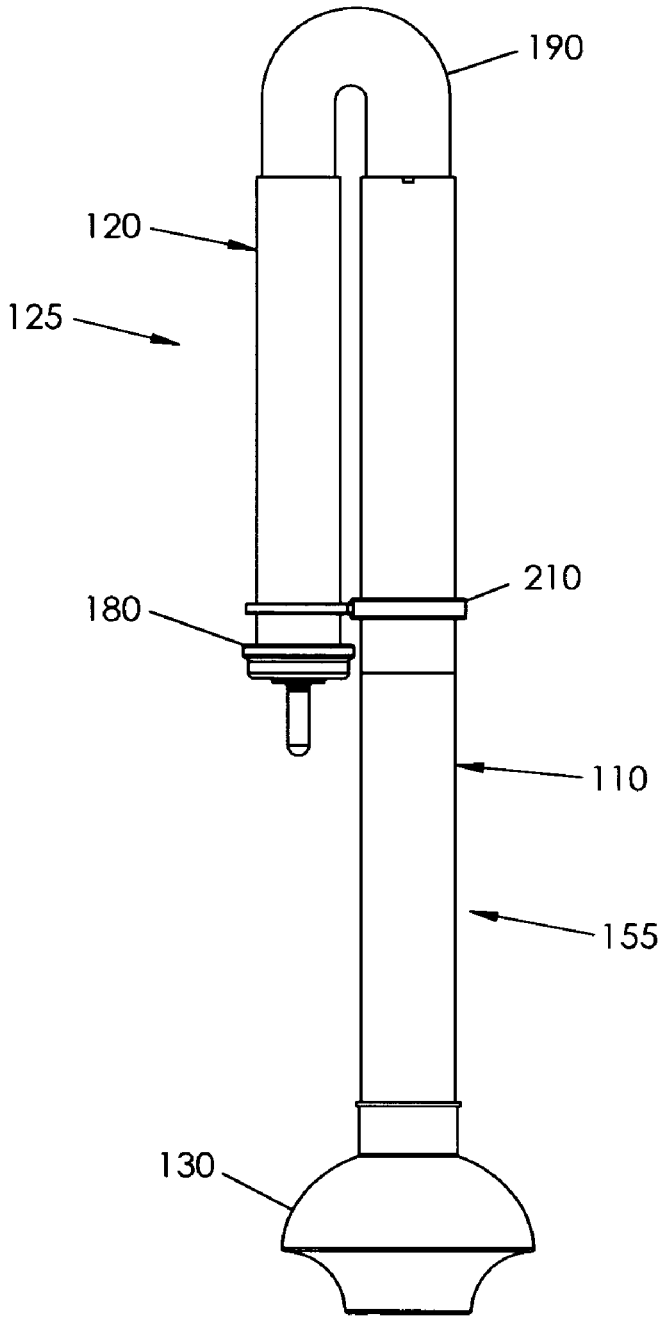
* and FIG. 5 is a perspective view of the drain-clearing device as in FIG. 1*a* illustrating a rubber hose connecting the first and second hollow tubes.

The crank handle 140 is coupled to the second end 122 of the second hollow tube 120 (FIGS. 1*a*, 1*b*, 3*a*, 4*a*, 4*b* and 4*c*). The snaking member 150 is housed within the first and second tubes 110, 120 and coupled to the crank handle 140 for selective rotational movement as shown in FIGS. 4*b* and 4*c*. When the first and second tubes 110, 120 are moved telescopically between the extended and retracted configurations 125, 126, the snaking member 150 is moved between a storing configuration 155 (FIGS. 1*a* and 3*a*) and an operating configuration 156 (FIGS. 1*b* and 4*a*), respectively. The snaking member 150 may have a spring type construction 151 as shown in FIG. 2 and may be selectively removable from the first and second tubes 110, 120 for cleaning.

Figure 3B:
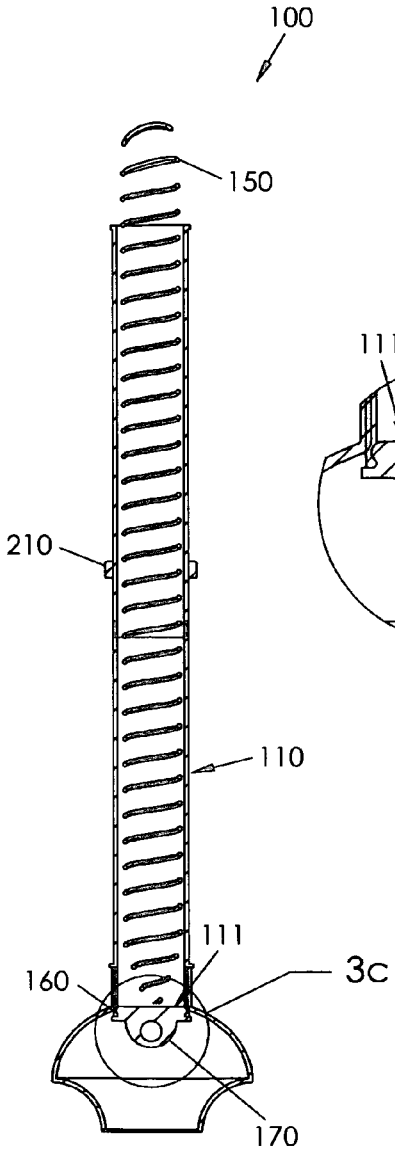
FIG. 3*b* is a sectional view taken along line 3*b*-3*b* of FIG. 3*a;*
Figure 3C:
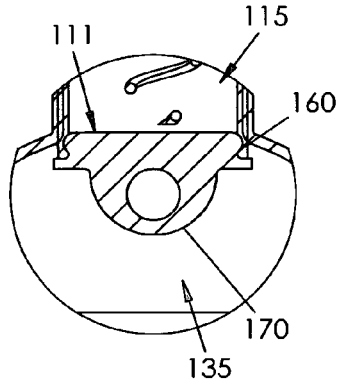
FIG. 3*c* is an isolated view on an enlarged scale taken from FIG. 3*b;*

The plunger head 130 is coupled to the first end 111 of the first hollow tube 110 (FIG. 2), and means for selectively sealing the inner area 115 of the first hollow tube 110 from an inner area 135 of the plunger head 130 may be included (FIGS. 2 and 3*c*). For example, either the first hollow tube 110 or the plunger head 130 may define a groove 160 adjacent the first end 111 of the first hollow tube 110 as shown in FIGS. 3*b* and 3*c*. A plug 170 may have a configuration complementary to a configuration of the groove 160, and the plug 170 may be selectively coupleable with the groove 160 to separate the inner area 115 of the first hollow tube 110 and an inner area 135 of the plunger head 130 as shown in FIG. 3*c*. The plug 170 may also be otherwise selectively coupled to the first end 111 of the first hollow tube 110 to seal the inner area 115 of the first hollow tube 110 from an inner area 135 of the plunger head 130.

A cap 180 (FIG. 2) may be coupled to the crank handle 140 and the second end 122 of the second hollow tube 120. The cap 180 may have a configuration complementary to a configuration of the second end 112 of the first hollow tube 110 for selectively coupling the cap 180 to the second end 112 of the first hollow tube 110 when the first and second tubes 110, 120 are at the retracted configuration 126. The cap 180 may include an o-ring 181 (FIG. 2) to ensure that the second end 122 of the second hollow tube 120 and the cap 180 form a water-tight joint; this may prevent liquid from escaping outside the drain-clearing device 100.

In use, the drain-clearing device 100 may serve as both a plunger and plumbing snake for removal of stubborn clogs from a toilet, sink or other apparatus involving a drain. In the extended configuration 125, the drain-clearing device 100 resembles an ordinary bathroom plunger with a larger diameter handle as shown in FIGS. 1*a* and 3*a*. The flexible rubber hose 190 may enable the second hollow tube 120 to extend to a parallel position with respect to the first hollow tube 110. To utilize the drain-clearing device 100 as a plunger, the plug 170 may be coupled to the groove 160 to separate the inner area 115 of the first hollow tube 110 from the inner area 135 of the plunger head 130 (FIG. 3*c*) and to prevent the snaking member 150 from deploying outside the first and second tubes 110, 120.

In the retracted configuration 126, the second hollow tube 120 may be inserted inside the first hollow tube 110 as shown in FIG. 4*c*. Manual removal of the plug 170 from the groove 160 enables deployment of the snaking member 150 in the operating configuration 156 as shown in FIGS. 1*b*, 4*a* and 4*b*. The snaking member 150 may extend below the inner area 115 of the first hollow tube 110 and therethrough the inner area 135 of the plunger head 130. Because the snaking member 150 is coupled to the crank handle 140, when the crank handle 140 is turned, the snaking member 150 may move in a selectively rotational manner within a drain for dislodging or removal of stubborn clogs. After exiting the drain, the snaking member 150 may be repositioned inside the first and second hollow tubes 110, 120 by operation of the crank handle 140 and moving the tubes to the extended configuration 125, and the plug 170 may be reinserted into the groove 160, thus returning the snaking member 150 to the storing configuration 155 (FIGS. 1*a* and 3*a*). The flexible rubber hose 190 and the cap 180 help to prevent excess moisture remaining on the snaking member 150 from exiting the first and second tubes 110, 120 to the exterior environment. The o-ring 181 may help prevent unsanitary moisture from spilling out of the drain-clearing device 100.

It is understood that while certain forms of this invention have been illustrated and described, it is not limited thereto except insofar as such limitations are included in the following claims and allowable functional equivalents thereof.

What is claimed is:

1. A drain-clearing device, comprising:

a first hollow tube having opposed first and second ends;

a plunger head coupled to said first end of said first hollow tube;

a second hollow tube having opposed first and second ends, said first end of said second hollow tube being operatively coupled to said second end of said first hollow tube, said first and second hollow tubes being configured for telescoping movement between an extended configuration and a retracted configuration;

a crank handle coupled to said second end of said second hollow tube;

a cap coupled to said crank handle and said second end of said second hollow tube;

a snaking member coupled to said crank handle for selective rotational movement and being housed within said first and second hollow tubes, said telescopic movement of said first and second hollow tubes between said extended and retracted configurations moving said snaking member between a storing configuration and an operating configuration, respectively; wherein said snaking member has a spring construction; said snaking member is selectively removable from said hollow tubes for cleaning; and a plug selectively coupled to said first end of said first hollow tube for sealing an inner area of said first hollow tube from an inner area of said plunger head; wherein said first hollow tube defines a groove adjacent said first end of said first hollow tube; and said plug having a configuration complementary to a configuration of said groove, said plug being selectively coupled with said groove for separating said inner area of said first hollow tube and said inner area of said plunger head;

wherein said second hollow tube includes a diameter that is smaller than a diameter of said first hollow tube; and said second hollow tube is selectively inserted inside said first hollow tube when said first and second hollow tubes are at said retracted configuration;

wherein said first hollow tube is parallel with said second hollow tube when said first and second tubes are at said extended configuration; said second end of said second hollow tube is located between said first and second ends of said first hollow tube when said first and second tubes are at said extended configuration; and a bracket selectively maintains said first and second tubes at said extended configuration in said parallel relationship when said first and second tubes are at said extended configuration;

wherein said cap having a configuration complementary to a configuration of said second end of said first hollow tube for selectively coupling said cap to said second end of said first hollow tube when said first and second tubes are at said retracted configuration.

2. The drain-clearing device as in claim 1, wherein said cap includes an o-ring such that said second end of said second hollow tube and said cap form a water-tight joint.

3. The drain-clearing device as in claim 1, wherein said second end of said first hollow tube is coupled to said first end of said second hollow tube by a flexible rubber hose when said hollow tubes are at said extended configuration.

4. The drain-clearing device as in claim 1, wherein said first hollow tube includes a plurality of tube portions threadably coupled to one another.

5. A drain-clearing device, comprising:

a first hollow tube having opposed first and second ends;

a plunger head coupled to said first end of said first hollow tube;

a second hollow tube having opposed first and second ends, said first end of said second hollow tube being operatively coupled to said second end of said first hollow tube, said first and second hollow tubes being configured for telescoping movement between an extended configuration and a retracted configuration;

a crank handle coupled to said second end of said second hollow tube;

a cap couples said crank handle and said second end of said second hollow tube; wherein said cap includes an o-ring such that said second end of said second hollow tube and said cap for a water-tight joint;

a snaking member coupled to said crank handle for selective rotational movement and being housed within said first and second hollow tubes, said movement of said first and second hollow tubes between said extended and retracted configurations moving said snaking member between a storing configuration and an operating configuration, respectively; wherein said snaking member has a spring-like configuration; said snaking member is selectively removable from said hollow tubes for cleaning; and a plug for selectively sealing an inner area of said first hollow tube from an inner area of said plunger head; wherein at least one of said first hollow tube and said plunger head defines a groove adjacent said first end of said first hollow tube; and said plug having a configuration complementary to a configuration of said groove, said plug being selectively received in said groove for sealing said inner area of said first hollow tube from said inner area of said plunger head;

wherein said second hollow tube has a diameter smaller than a diameter of said first hollow tube; and said second hollow tube is positioned inside said first hollow tube when said first and second hollow tubes are at said retracted configuration;

wherein said first hollow tube is parallel with said second hollow tube when said first and second tubes are at said extended configuration; said second end of said second hollow tube is located between said first and second ends of said first hollow tube when said first and second tubes are at said extended configuration; and a bracket selectively maintains said first and second tubes at said extended configuration in said parallel relationship when said first and second tubes are at said extended configuration;

wherein said cap has a configuration complementary to a configuration of said second end of said first hollow tube to selectively couple said cap to said second end of said first hollow tube when said tubes are at said retracted configuration.

6. The drain-clearing device as in claim 5, wherein:

said second end of said first hollow tube is coupled to said first end of said second hollow tube by a flexible rubber hose when said hollow tubes are at said extended configuration; and said first hollow tube includes a plurality of tube portions threadably coupled together.

* * * * *